US005673820A

United States Patent [19]

Green et al.

[11] Patent Number: 5,673,820

[45] Date of Patent: Oct. 7, 1997

[54] JUICE DISPENSER

[75] Inventors: Thomas S. Green, Atwater; Melvin H. Davis, Uniontown, both of Ohio

[73] Assignee: ABC Dispensing Technologies, Inc., Akron, Ohio

[21] Appl. No.: 527,622

[22] Filed: Sep. 13, 1995

[51] Int. Cl.[6] ..... B67D 5/56

[52] U.S. Cl. ..... 222/129.3; 220/510; 220/512; 222/129.1; 222/143

[58] Field of Search ..... 222/56, 129.1, 222/129.2, 129.3, 129.4, 143; 220/507, 510, 512; 206/509

[56] References Cited

U.S. PATENT DOCUMENTS

| | | | |
|---|---|---|---|
| Re. 30,962 | 6/1982 | Bridges | 206/509 X |
| 1,011,794 | 12/1911 | Houser | 220/512 X |
| 1,054,035 | 2/1913 | Ruhnau | 220/512 |
| 2,556,844 | 6/1951 | Istwan | 220/512 X |
| 4,860,923 | 8/1989 | Kirschner et al. | 222/129.1 X |
| 4,932,564 | 6/1990 | Austin et al. | 222/144.5 X |
| 4,955,507 | 9/1990 | Kirschner et al. | 222/129.4 X |
| 4,986,449 | 1/1991 | Valiyee et al. | 222/144.5 |
| 5,011,043 | 4/1991 | Whigham et al. | 222/129.4 X |
| 5,033,644 | 7/1991 | Tentler | 222/129.4 X |

FOREIGN PATENT DOCUMENTS

| | | | |
|---|---|---|---|
| 0232494 | 9/1989 | Japan | 222/129.4 |

*Primary Examiner*—Joseph Kaufman

*Attorney, Agent, or Firm*—Renner, Kenner, Greive, Bobak, Taylor & Weber

[57] ABSTRACT

A juice dispenser for providing a known quantity of juice at each dispensing cycle, wherein a supply of juice concentrate is transferred by a hose to a dispensing head and wherein a controller monitors a pressure transducer connected to one of the hose and a dispensing head so that the controller can determine a viscosity value of the juice concentrate based on readings of the pressure transducer and accordingly determine a count indicative of the volume of the juice concentrate dispensed in such a manner that the controller can adjust the count depending upon the viscosity value determined at each dispense cycle. The juice dispenser dispenses juice concentrate and water into cups supported by a thermally insulated tray wherein the tray has at least one cavity for receiving thermal material and which supports an insulation plate that carries the group of cups in such a manner that temperature variation is minimized so as to maintain the temperature of the juice within a desired range. The tray is constructed with nesting members so that multiple trays can be stacked upon one another.

19 Claims, 3 Drawing Sheets

JUICE DISPENSER

TECHNICAL FIELD

The invention herein resides generally in the art of beverage dispensers that provide a known quantity of beverage at each dispensing cycle. More particularly, the present invention relates to a juice dispenser that dispenses a known quantity of chilled juice into cups carried by a stackable thermally insulated tray that thermally insulates the group of cups. Specifically, the present invention relates to a juice dispenser with a controller which determines the viscosity of a fruit juice concentrate and regulates the dispensing cycle as a function of such viscosity as determined at the beginning of each dispensing cycle.

BACKGROUND ART

Various types of beverage and juice dispensers for dispensing a quantity or volume of juice are well known. Often, the dispensing is done manually by estimating the volume of juice dispensed from a pitcher or other such container into a glass or cup for individual consumption. Automated dispensing devices have been developed to speed up this process. One such device dispenses juice by pressing a button so that juice flows from a dispensing head into a cup until such time that the operator releases the button to stop the flow of juice into the cup. With another automated device, an operator touches a button once and the dispensing device automatically mixes a concentrate or syrup with water or carbonated water and the dispenser dispenses a predetermined amount of beverage. It is also known to provide a similar type of arrangement where the dispensing head is attached to a flexible hose and wherein the operator manually selects different types of beverages from the dispensing head.

All of the above automated beverage dispensing devices have been used in one form or another in institutions such as hospitals and nursing homes. Some state laws and regulations mandate that nursing homes provide a minimum amount of juice to each patient during a twenty-four hour period. In particular, these regulations require that the juice have a minimum percentage of natural fruit juice concentrate and that the juice be served within a predetermined range of temperature. Unfortunately, none of the above automated dispensing devices can be employed to repeatably provide a fixed quantity of juice having an acceptable percentage of concentrate at a predetermined range of temperature. Additionally, the above-methods are too slow to provide the large number of filled individual cups required in a nursing home environment. Nor do the above dispensers provide a facile means for monitoring the temperature requirement. Moreover, none of the above described dispensing devices compensate for anomalies within the dispensing unit.

Based upon the foregoing, it is evident that there is a need in the art for a juice dispenser to provide a known quantity of juice at each dispensing cycle, wherein the juice is chilled to a predetermined temperature range at an acceptable juice concentration level. There is also a need to provide a thermally insulated tray to be used in conjunction with the juice dispenser wherein the tray can accomodate large numbers of individual cups of juice while still maintaining the required predetermined range of temperature.

DISCLOSURE OF INVENTION

In light of the foregoing, it is first aspect of the present invention to provide a fixed quantity juice dispenser.

Another aspect of the present invention is to provide a fixed quantity juice dispenser that repeatably dispenses a known quantity of chilled juice that maintains an assured minimum percentage of juice concentrate and is served at a predetermined range of temperature.

Yet another aspect of the present invention is to provide a fixed quantity juice dispenser as described above, wherein a controller monitors the pressure of the dispensed juice and adjusts the dispensing time of a dispensing cycle accordingly to dispense the desired quantity.

Still a further aspect of the present invention is to provide a fixed quantity juice dispenser as described above, wherein a controller monitors the viscosity of the dispensed juice and adjusts the dispensing time of a dispensing cycle accordingly to dispense the desired quantity.

An additional aspect of the present invention is to provide a fixed quantity juice dispenser as described above, wherein the controller monitors a pressure transducer and adjusts the dispensing time accordingly to dispense a known quantity of juice while maintaining an assured minimum percentage of juice concentrate at a predetermined range of temperature.

Yet an additional aspect of the present invention is to provide a fixed quantity juice dispenser as described above, wherein a dispensing head is stored vertically to prevent leakage or cross-mixing of various juices during the dispensing process.

Still another aspect of the present invention is to provide a fixed quantity juice dispenser as described above, wherein the dispensing head is connected to a flexible hose and dispenses juice into cups disposed within a tray.

Still another aspect of the present invention is to provide a tray for thermally insulating a group of cups filled with juice from the juice dispenser.

Yet another aspect of the present invention is to provide a thermally insulated tray as described above, wherein the trays are stackable upon one another and wherein a cover is employed to enclose the top stackable tray.

Still another aspect of the present invention is to provide a thermally insulated tray as described above wherein the stackable tray carries a cooling or heating material.

Still another aspect of the present invention as described above is to provide a tray which supports the individual cups with an insulation plate in such a manner as to preclude the cups from contacting any other portion of the stackable trays and cooling or heating material.

The foregoing and other aspects of the present invention which shall become apparent as the detailed description proceeds are achieved by a juice dispenser to provide a known quantity of juice at each dispensing cycle, comprising: a supply of juice concentrate; a hose; a dispensing head connected to the supply of juice concentrate by the hose; and a controller for monitoring a pressure transducer connected to one of the hose and the dispensing head, wherein the controller determines a viscosity value of the supply of juice concentrate based on at least one reading of the pressure transducer and determines a reference count indicative of the volume of the supply of juice concentrate dispensed, and wherein the controller adjusts the count depending upon the viscosity value for each dispense cycle to dispense a known quantity of the supply of juice concentrate.

The present invention also provides in combination, a juice dispenser to repeatedly provide a known quantity of juice concentrate at a predetermined range of temperature for each dispensing cycle and a thermally insulated tray for carrying a group of cups filled with juice from the juice dispenser, comprising: a juice dispenser having a supply of juice concentrate and a supply of water; a dispensing head for dispensing the supply of juice concentrate and the supply of water to any number of cups; a chiller, connected between the supply of juice concentrate and the dispense head, for lowering the temperature of the supply of juice concentrate to a predetermined range of temperature; and a controller for monitoring a pressure transducer operative with the dispensing head, wherein the controller determines a viscosity value of the supply of juice concentrate based upon readings of the pressure transducer, determines a reference count indicative of the volume of the supply of juice concentrate dispensed, and wherein the controller adjusts the count depending upon the viscosity value for each dispensing cycle to dispense a known quantity of the supply of juice concentrate; and a thermally insulated tray having a stackable tray with at least one cavity for receiving a thermally conductive material, an insulation plate received within the stackable tray, the insulation plate having holes for supporting the cups, and a cover received on the top of the stackable tray to enclose and thermally insulate the group of juice filled cups.

The present invention also provides a apparatus for thermally insulating a group of cups filled with juice from a juice dispenser, comprising: a stackable tray with at least one cavity for receiving a thermally conductive material; an insulation plate within the stackable tray, the insulation plate having a plurality of holes where each of the holes supports a cup; and a cover received on the top of the stackable tray to enclose and thermally insulate the group of cups.

The present invention also provides a juice dispenser to provide a known quantity of juice at each dispensing cycle, comprising: a supply of juice concentrate; a hose; a dispensing head connected to said supply of juice concentrate by said hose; and a controller for monitoring a pressure transducer connected to one of said hose and said dispense head, wherein said controller readings of said pressure transducer to determine a reference count indicative of the volume of said supply of juice concentrate dispensed, and wherein said controller controls the flow of said supply of juice concentrate for each dispense cycle until said reference count is obtained to dispense a known quantity of said supply of juice concentrate.

BEST MODE FOR CARRYING OUT THE INVENTION

Figures 1, 2:
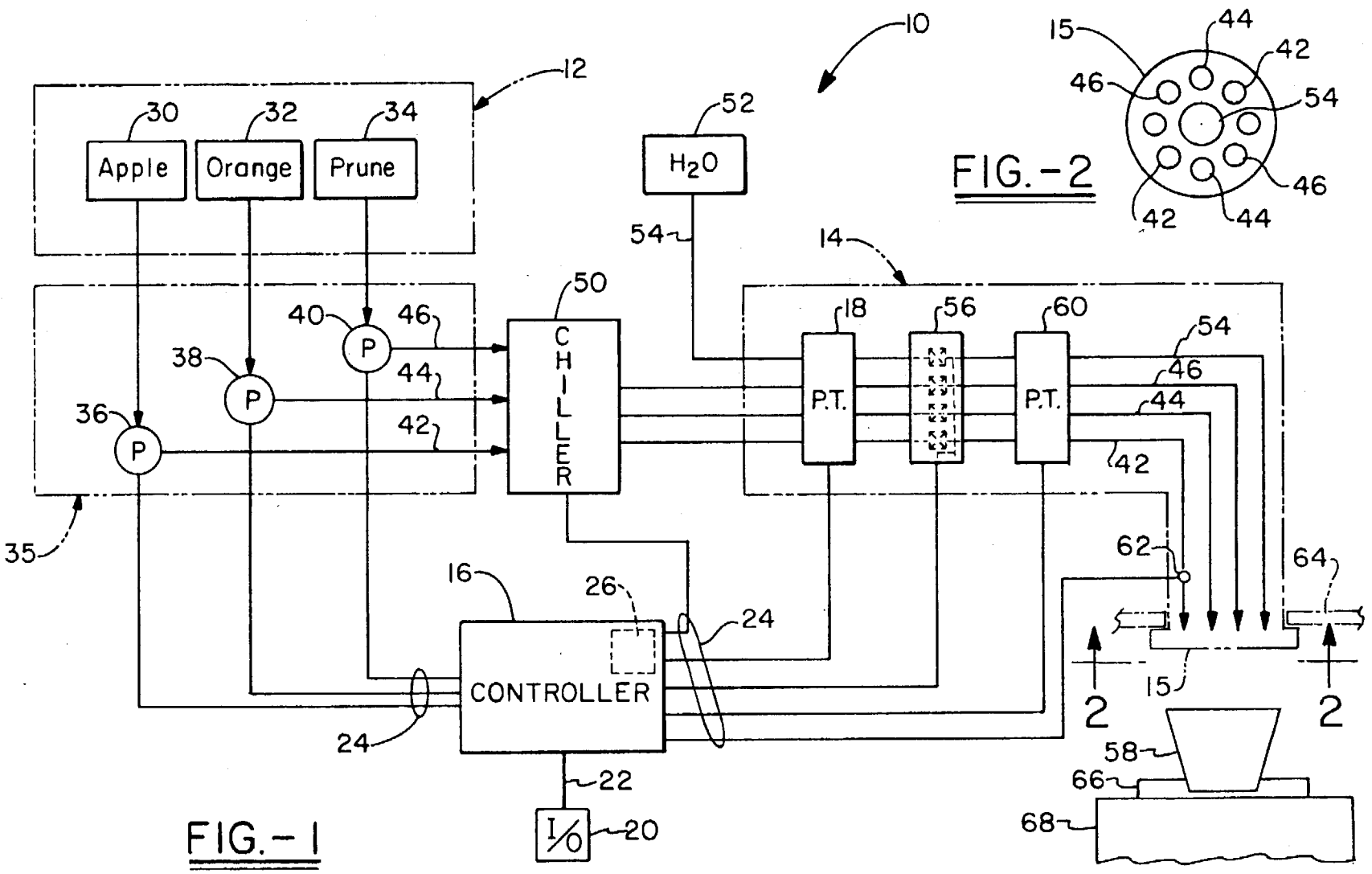
FIG. 1 is a schematic diagram illustrating a juice dispenser according to the invention positioned to repeatably dispense a fixed quantity of juice into a cup supported by a thermally insulated tray.
FIG. 2 is a bottom view of a dispensing head according to the present invention.

Referring now to the drawings and more particularly to FIG. 1, it can be seen that a juice dispenser according to the present invention is designated generally by the numeral 10. The juice dispenser 10 includes a supply of juice concentrate 12, a hose or conduit 14, which connects the concentrate juice supply 12 to a dispensing head 15, and a controller 16 for monitoring a pressure transducer 18 positioned in a syrup flow path in either the hose 14 or the dispensing head 15. As will be presented below, the controller 16 determines a viscosity value of the juice concentrate of the supply 12 based upon readings of the pressure transducer 18 and further determines a reference flow rate of the juice concentrate being dispensed. Additionally, the controller 16 adjusts the time during which concentrate is dispensed depending upon the viscosity value determined at each dispensing cycle to assure that a fixed quantity of juice concentrate is dispensed. It will be appreciated that the basic premise of the operation of the juice dispenser 10 is that by monitoring a pressure value of the juice concentrate while it is being dispensed, a corresponding viscosity value of the concentrate can be determined. As such, when the viscosity value of the juice concentrate increases, the rate of juice flow is reduced and more time is required to dispense the fixed amount of juice concentrate necessary to assure a juice drink satisfying minimum percentage requirements of natural juice concentrate. Conversely, when the viscosity value of the juice concentrate decreases, the rate of flow of the concentrate is increased and less time is required to dispense the fixed amount of concentrate. Therefore, by monitoring the viscosity value at each dispensing cycle, the controller 16 can adjust the amount of time that valves within the dispensing head are open to provide a precise quantity of dispensed juice concentrate. It will, of course, be appreciated that the viscosity of the water mixed with the concentrate 12 in the fruit juice drink remains substantially constant. Accordingly, only time adjustments for the concentrate dispensing cycle are required, as a function of viscosity, to assure consistent drinks having acceptable juice concentrate percentages.

If desired, the juice dispenser 10 is configurable to monitor just a pressure value within either the hose 14 or the dispensing head 15. Whenever a lower pressure reading is determined by the controller 16, the length of the dispensing cycle is increased to compensate for the reduced volume of concentrate dispensed at the lower pressure conversely, when a higher pressure reading occurs, the dispensing cycle is shortened to compensate for the increased volume of concentrate dispensed. By monitoring pressure readings, the controller 16 can adjust the dispensing cycle to ensure that the correct volume is dispensed. In other words, each dispense cycle has an integrated pressure curve or area equal to a volume of dispensed juice concentrate.

In particular, the juice dispenser 10 includes an input/output device 20 connected by a signal line 22 to the controller 16 for the purpose of providing a communication link between an operator and the juice dispenser 10. The input/output device 20 allows the operator to input to the controller 16 a selection of the juice to be dispensed, as well as the volume or "size" of the drinks to be dispensed. The input/output device may also display the operational status of components within device 10.

The controller 16 receives data and input requests and generates the appropriate control signals for use by the juice dispenser 10. In particular, the controller 16 sends instructions to components within the dispenser 10 by a signal line 24. The signal line 24 includes multiple signal lines connected to the controller 16 for monitoring the operational status of each component within dispenser 10. Included in the controller 16 is a look-up table 26 which contains information correlating sensed pressure to effective viscosity. The controller 16 monitors pressure information sent from the pressure transducer 18 and accordingly regulates the dispensing time cycle for the juice concentrate.

The supply of juice concentrate 12 can include any number of juice concentrates that is desired. In the embodiment shown, three different types of juice concentrates—apple 30, orange 32 and prune 34—are shown. Each supply of juice concentrate 30–34 is connected to a pump system 35. In particular, the apple juice concentrate 30 is connected to a pump 36, the orange juice concentrate 32 is connected to a pump 38, and the prune juice concentrate 34 is connected to a pump 40. Each pump 36–40 is connected to a respective flow line—pump 36 to a flow line 42, pump 38 to a flow line 44, and pump 40 to a flow line 46—for transferring the associated juice concentrate 12 through conduit 14 to the dispensing head 15. In the preferred embodiment, pumps 36–40 are operated continuously to pressurize flow lines 42–46. However, it is within the scope of the present invention that each pump 36–40 could be selectively operated by the controller 16 via signal line 24. Although any type of pumping device could be used, in the preferred embodiment the pumps 36–40 are positive displacement pumps such as known "bag-in-box" pumps.

A chiller or refrigeration unit 50, which is also connected to control signal line 24, receives the concentrate from flow lines 42–46. The chiller 50 functions to lower the temperature of the concentrate to a predetermined range of temperature. In the preferred embodiment, the chiller 50 reduces the temperature of the juice concentrate to between 33° and 38° F. The concentrate exits the chiller 50 through respective flow lines 42–46 to the hose 14. Those skilled in the art will appreciate that the hose 14 is a flexible conduit which can receive multiple flow lines and accommodates various control signal lines 24 as required for the operation of the controller 16.

A supply of water 52, designated as $H_2O$ in FIG. 1, is supplied to the dispensing head 15 for mixing with the appropriate concentrate 30–34 via a flow line 54. As seen in FIGS. 1 and 2, the flow lines 42–46 carrying the juice concentrate 30–34 are circumferentially positioned around the flow line 54 carrying the water 52 in dispense head 15. In this embodiment, each flow line 42–46 is divided into two branches with the branches opposing one another in dispensing head 15, wherein the water flow line 54 is disposed therebetween. If desired, the flow line 54 could be directed through the chiller 50 to ensure that the water 52 is provided at the appropriate temperature range.

A series of valves 56, wherein each flow line 42, 44, 46 and 54 is connected to an individual valve within the series of valves, are connected to the controller 16 by signal line 24. Therefore, depending upon operator input, particular valves are opened for a predetermined period of time to dispense both the juice concentrate (30, 32 or 34) and the water 52 into a cup 58. The valves 56 could be a solenoid type valve, a pinch valve or any similar valve known in the art. At the initial set-up of dispenser 10, the series of valves 56 and pump 36 may require adjustment to obtain the desired operational performance and to assure attainment of appropriate concentration or "brix" levels.

The pressure transducer 18 in this embodiment is a series of pressure transducers individually connected to each flow line 42, 44, 46 and 54 within the conduit 14. Of course, control line 24 interconnects each pressure transducer 18 to the controller 16. In addition to the series of pressure transducers 18 being operatively connected to the dispense head 15 for monitoring the pressure of the selected juice concentrate as it is dispensed, the device 10 may also include a series of pressure transducers 60 which are positioned downstream of the valves 56 and are each connected to a respective flow line 42–46 and 54.

An activation or start button 62 is located on the dispensing head 15 for the purpose of starting and stopping the flow of juice concentrate 30–34 and water 52. The start button 62 is connected to the controller 16 by a control line 24. Those skilled in the art will appreciate that the dispensing head 15 is detachably mounted within a mounting bracket 64 in a substantially vertical position to prevent cross-mixing of juices. For example, after a dispensing cycle of apple concentrate 36, any remaining apple concentrate which may drip out of the dispensing head 15 will not mix with any of the other concentrate. Additionally, the vertical positioning of the head 15 assists in retaining concentrate in their respective lines through surface tension, vacuum retention, and the like, as well known in the art.

Once the start button 62 is activated, the dispense head 15 dispenses the juice into a cup 58 that is carried by a tray 66. Typically, the tray 66 is supported by a stand or table 68 which may or may not be a part of the juice dispenser 10.

As mentioned previously, a reference flow rate of the concentrate is determined by the controller 16 based on readings from the series of pressure transducers 18. For example, as apple concentrate 30 is dispensed, the pressure transducer monitoring flow line 42 senses and sends periodic pressure readings to the controller 16 via control line 24.

Figure 3:
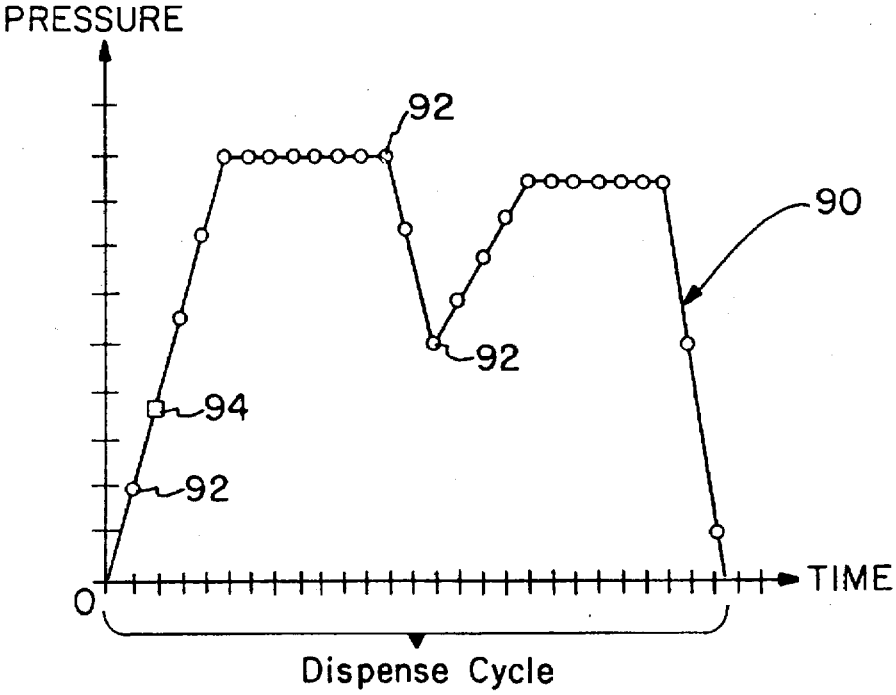
FIG. 3 is a graphical representation of an exemplary pressure curve monitored by the juice dispenser of the invention.

As best seen in FIG. 3, a pressure curve 90 represents a typical series of pressure readings during a dispense cycle. By knowing the structure of the juice dispenser 10 and its related operating parameters, the pressure curve 90 provides a reference or standard for an acceptable dispensing cycle. The reference is equal to the summation of the pressure readings taken during the dispense cycle. In particular, the pressure curve 90 shows that periodic readings 92 of juice concentrate are taken at predetermined intervals during a dispensing cycle. In order to properly determine a viscosity value of the concentrate being dispensed, a pressure reading 94, which is taken at some time period after the commencement of the dispensing operation, is employed. As those skilled in the art will appreciate, the pressure curve 90 may have fluctuations or interruptions which correspond to anomalies within the juice dispenser, such as incomplete openings of valves 56, variations in pump 36–40 operation, reversal of pump stroke, movement of the hose 14 and other such events. Additionally, variations in concentrate temperature directly affect the viscosity of the concentrate, and as will be explained, dictates the time period of each dispense cycle.

In operation, the operator dispenses a test sample to obtain the desired quantity of juice. After the appropriate valve 56 is opened, the pressure transducer 18 reads a pressure value at periodic intervals, for example 10 milliseconds, and assigns a value for each reading during the test dispensing cycle. If the amount of juice concentrate dispensed is the amount desired, resulting in a drink of appropriate natural juice concentration, the readings 92 are summed to provide a reference value or "count" indicative of an appropriate volume of juice concentrate for an acceptable beverage. At subsequent dispensing cycles, the pressure reading 94, which correlates to the viscosity of the juice concentrate for that particular dispensing cycle, is received by the controller 16. The look-up table 26 contains data which correlates sensed pressure with viscosity, which in turn correlates sensed pressure with flow rate. Accordingly, by sensing the dispensing pressure early in the dispensing cycle, the juice concentrate viscosity (and, hence, flow rate) can be determined and adjustments made to the dispensing time period to assure that the appropriate amount of concentrate is dispensed. Effectively, each possible pressure reading contained within the look-up table 26 corresponds to an adjustment factor which is employed by the controller 16 to revise the reference count value to an adjustment count value. As such, each dispensing cycle is terminated when the summation of the periodic pressure readings 92 equals the adjusted count value. The appropriate valve 56 is closed upon receiving a signal from the controller 16 that the adjusted count value has been reached. It will be appreciated that the pressure reading 94 is taken relatively early in the dispense cycle so that the adjustments in the court value can be made. However, the pressure reading 94 is typically not the first pressure reading taken as the first reading may not provide an accurate viscosity value.

As mentioned previously, the juice dispenser 10 can operate by employing just the pressure readings determined by the controller 16. For example, if an anomaly within the dispenser 10 reduces the dispensing pressure during a dispense cycle, the value of the readings 92 are reduced indicating to the controller 16 that the appropriate valve should remain open until the desired count value is obtained. Therefore, in this embodiment, the readings 92 are summed to equal a count value that is indicative of the desired quantity of dispensed juice without reference to the viscosity thereof. Generally, viscosity of the concentrate is not an important factor where the components of the dispenser 10 are in relative close proximity to one another.

As seen in FIG. 1, there are various positions from which the pressure transducers 18 and 60 can provide the necessary pressure information to the controller 16 for adjustment of the count value. For example, pressure transducer 18 or pressure transducer 60 can directly provide the pressure reading to the controller 16 for analysis. Another method of determining the viscosity of the concentrate is to check the pressure at the pressure transducer 18 before the dispensing commences to measure a static pressure and then take another pressure reading when the appropriate valve 56 is opened to measure a dynamic pressure so that a system pressure loss can be determined which corresponds to a viscosity value. A final example of determining viscosity is where two pressure transducers are employed. A first pressure transducer measures a static pressure and a dynamic pressure which are compared to similar readings of a second pressure transducer 62 wherein the first and second pressure transducers are separated by a fixed distance so that a pressure drop can be determined which correlates to the viscosity value of the concentrate being dispensed.

Figure 4:
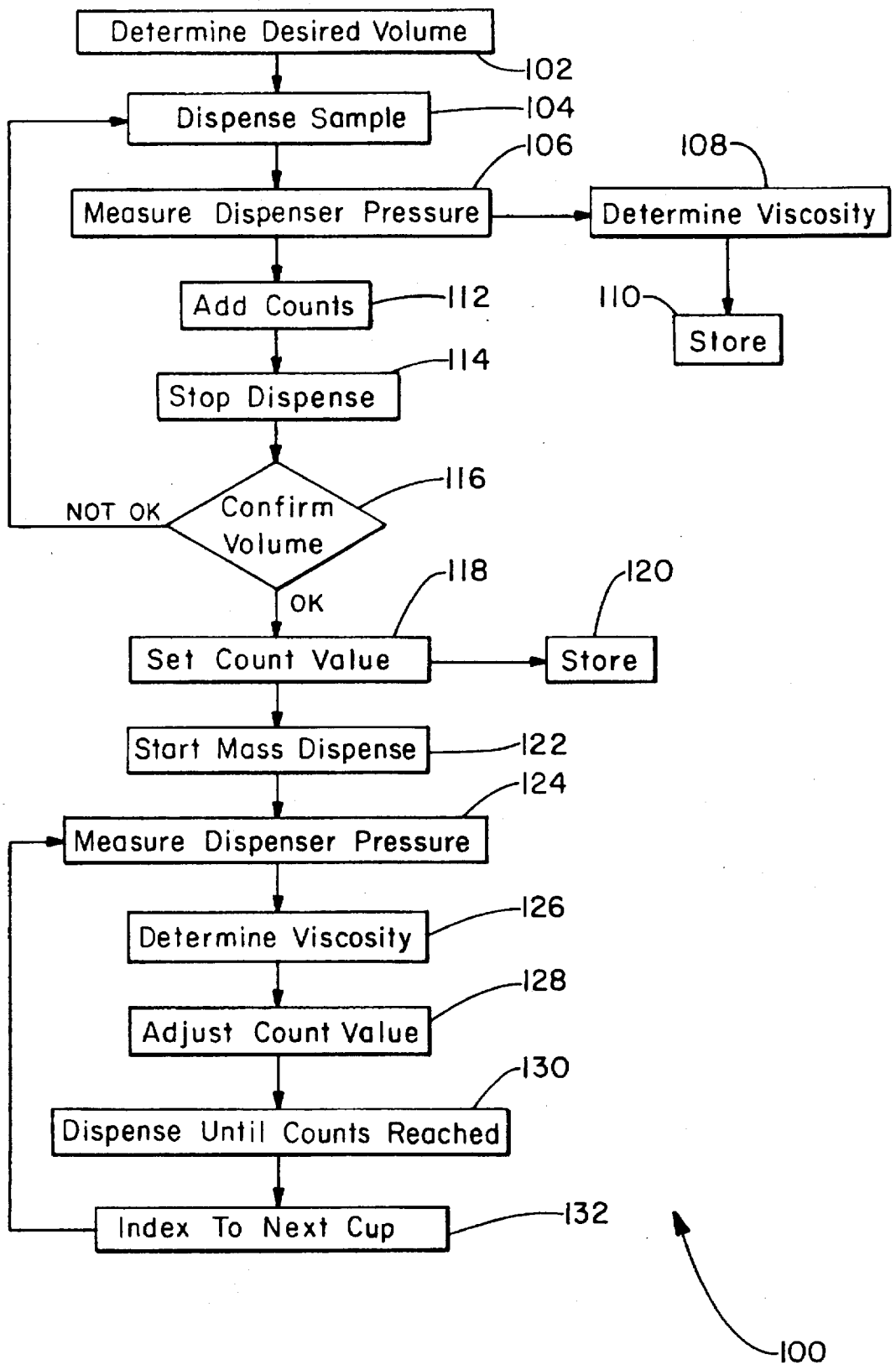
FIG. 4 is a top level flow chart illustrating the operation of the juice dispenser.

Referring now to FIG. 4, a method of operating the juice dispenser 10 is generally indicated by the numeral 100. At step 102, the operator of the juice dispenser 10 determines the volume required to be dispensed in each cup 58. After selecting the flavor of juice desired, the operator dispenses a sample at step 104 by pressing and holding the actuation button 62 until the desired volume is attained. At step 106, the controller 16 measures dispensing pressure provided by the pressure transducers 18 or 60 in any manner described above so that at step 108 a viscosity value of the concentrate can be determined. At step 110, the viscosity and pressure readings are stored in the controller 16 for later analysis. At step 112, the controller 16 sums the pressure readings to establish a reference value or "count". In other words, the pressure readings for each time interval during the initial dispense cycle are added. Once the operator determines that the volume desired has been attained, the actuation button 62 is released and the dispensing cycle is stopped at step 114. At this time, the operator at step 116 confirms the volume dispensed is of the desired amount. If the volume dispensed does not fall within the range of volumes required, the method 100 returns to step 104 so that the operator can repeat steps 104 through 114. However, if at step 116 it is determined that the volume dispensed is within the desired range of volumes, the method 100 continues at step 118.

At step 118, the controller 16 sets a reference count value and stores this information in the controller 16 at step 120. At this time, the operator can start dispensing juice into cups in a quick and efficient manner by touching the activation button 62 once and releasing. For each individual dispensing cycle, the controller 16 at step 124 measures a dispense pressure in the early stages of the dispense cycle. Accordingly, at step 126, the controller evaluates the pressure readings and determines a corresponding viscosity value or flow rate of the concentrate being dispensed. If at this time, the controller 16 determines that the viscosity of the concentrate will abnormally affect the amount and percentage of concentrate dispensed, the controller at step 128, adjusts the count value accordingly. As such, at step 130 the appropriate valve 56 remains open until the adjusted count value has been reached and accordingly the desired volume of juice concentrate is attained. After the dispense cycle, the operator indexes the dispense head 15 to the next cup to receive juice. At this time the methodology 100 returns to step 124 to await the next dispense cycle.

Figure 5:
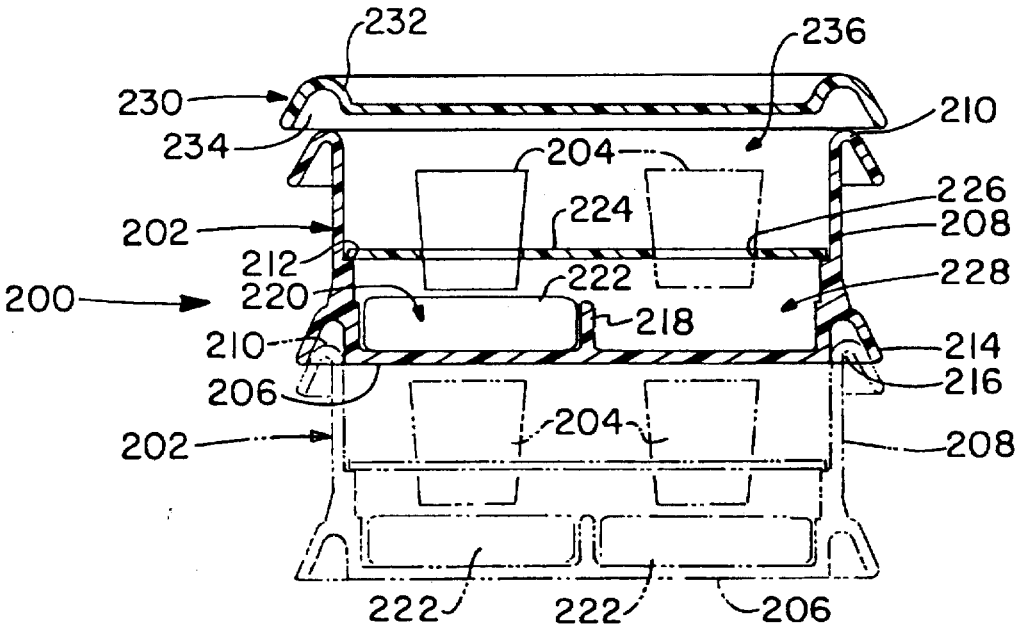
FIG. 5 is a cross-sectional view of a thermally insulated tray carrying cups filled with a known quantity of juice dispensed from the juice dispenser.

Referring now to FIG. 5, an appreciation of one tray 66 made in accordance with the invention can be seen. Here, the tray 66 comprises a thermally insulated tray 200 which thermally insulates a group of cups filled with the juice from the fixed quantity juice dispenser 10.

In particular, the tray 200 includes a stackable tray 202 which carries cups 204. Structurally, the stackable tray 202 has a bottom 206 with an upwardly extending wall 208 which extends around the perimeter of the bottom 206. It will be appreciated then that the stackable tray 202 could be rectangular, circular, or any other shape desired. Outwardly and downwardly extending from the top edge of the wall 208 is a rim or nesting member 210. Extending inwardly from the interior of the wall 208 is a shoulder 212. At the bottom edge of the wall 208 is an outwardly extending lip 214 which forms a notch or second nesting member 216 between the lip 214 and the bottom 206.

Extending upwardly from the top side of the bottom 206 is a protrusion 218 which forms a cavity or pocket 220 for receiving a temperature or thermally conductive material 222. Those skilled in the art will appreciate that the material 222 could be in form of ice packs or a gel type material that has been frozen and which provides the necessary cooling action to maintain a predetermined range of temperature of the juice contained within cups 204. Alternatively, the material 222 could be a sustainable heat emitting material for maintaining a desired range of warming temperatures for hot drinks such as coffee or cider.

An insulation plate 224 is supported by the shoulders 212 and received within the stackable tray 202. The insulation plate 224 has a plurality of holes or apertures 226 for receiving and carrying the cups 204. Those skilled in the art will appreciate then that the insulation plate 224 is sealingly engaged with the shoulder 212 so as to form an insulated area 228 between the insulated plate 224, the bottom 206 and the wall 208 between the bottom 206 and the shoulders 212. Moreover, when each hole or aperture 226 of the insulation plate 224 carries a cup 204, the insulated area 228 becomes a sealed compartment thus further maintaining the temperature of the juice in cups 204.

A cover 230 is received on the top of the stackable tray 202 to enclose and thermally insulate the group of juice filled cups 204. The cover has an edge 232 which forms a channel 234 on the underside thereof and wherein the channel 234 is matingly received by the top of the rim 210. Those skilled in the art will appreciate that the channel 234 also forms a second nesting member structurally equivalent to nesting member 216. As such, when the cover 230 is disposed on top of the stackable tray 202, a second insulated area 236 is formed. In particular, the second insulated area 236 is formed by the cover 230, the insulation plate 224, and the portion of the wall 208 between the shoulders 212 and the rim 210. Moreover, when cups 204 completely fill all of the holes 226, the second insulated area 236 becomes a sealed compartment. It will be appreciated that the size of cup 204 is selected such that it is carried by the insulation plate 224 in such a manner that the cup 204 does not come in contact with any other portion of the stackable tray 202 or the material 222. The configuration of the nesting members 210 and 216 are such that the first and second nesting members are receivable by nesting members of other stackable trays 202 as shown in FIG. 5. As such, insulated area 236 could be formed by the underside of bottom 206 and the wall 208 and insulation plate 224 of a second stackable tray 202. Moreover, the thermal insulation properties of the stackable tray 202 are equally applicable to maintaining a temperature range of heated beverages, wherein the material 222 is a heat emitting material.

From the above description of the structure and methodology of the juice dispenser 10 and the thermally insulated tray 200, it should be apparent that the ability to repeatedly provide a fixed quantity of juice with the proper percentage of concentrate and at the proper temperature is greatly enhanced. In particular, the advantages of the juice dispenser 10 are that a repeatable dispensing cycle, regardless of changes in dispensing pressure or concentrate viscosity, can be attained. Another advantage of the juice dispenser 10 is that it compensates for changes in temperature of the supply of juice concentrate 12, fluctuation in the operation of the chiller device 50 and other anomalies within the device 10. In a similar fashion, the juice dispenser 10 can accomodate variations in the pumping operation which directly effects the dispensing pressure within the dispensing head 15. As such, any system anomaly within the juice dispenser 10 can be accounted for. Therefore, the present invention repeatedly provides a fixed quantity chilled drink with the correct percentage of juice concentrate to meet state laws and regulations.

Yet another operational advantage of the juice dispenser 10 is provided by the structure of the mounting bracket 64. By removing the dispense head from the mounting bracket 64, the operator is allowed to index or move the flexible hose 14 and the dispense head 15 over the desired cup to dispense the juice. Alternatively, the operator could leave the dispense head 15 within the mounting bracket 64 in a tower configuration and move or index a juice receiving cup under the dispense head for each dispensed cycle. These methods allow the operator to choose the most efficient dispensing method for a particular dispensing situation.

The thermally insulated tray 200 also provides an advantage in maintaining a large number of cups of juice at a desired temperature range. The structure of the thermally insulated tray 200 is such that the loss of cooling action is minimized and that the juice is maintained at the desired temperature. This is achieved by providing the juice cups in compartments which are arranged such that any cooling or heating transfer is usually received by a tray above or below another tray.

Thus it can be seen that the objects of the invention have been attained by the structure and methodology presented above. While in accordance with the patent statutes only the best mode and preferred embodiment of the invention has been presented and described in detail, the invention is not limited thereto or thereby. Accordingly, for an appreciation of the true scope and breadth of the invention, reference should be made to the following claims.

What is claimed is:

1. A juice dispenser to provide a known quantity of juice for each dispensing cycle, comprising:

a supply of juice concentrate;

a hose;

a dispensing head connected to said supply of juice concentrate by said hose;

a pressure transducer connected to one of said hose and said dispensing head to provide pressure readings throughout a dispense cycle; and controller means for a) receiving the pressure readings of the concentrate from said pressure transducer during a first despense cycle, b) summing the pressure readings from the first dispense cycle to provide a reference count, c) receiving a pressure reading from said pressure transducer during a subsequent dispense cycle to determine a viscosity of the concentrate, d) adjusting the reference count to an adjusted count value based upon the viscosity of the concentrate, e) receiving the pressure readings of the concentrate from said pressure transducer during the subsequent dispense cycle, and f) terminating the flow of concentrate when the summation of the pressure readings of the subsequent dispense cycle equals the adjusted count value.

2. The juice dispenser according to claim 1, wherein said controller means further includes mean for determining the viscosity value at a predetermined time after the dispensing cycle has commenced.

3. The juice dispenser according to claim 2, further comprising:

a pump for transferring said supply of juice concentrate to said hose; and a chiller, connected between said supply of juice concentrate and said dispensing head, for lowering the temperature of said supply of juice concentrate to a predetermined range of temperature.

4. The juice dispenser according to claim 3, wherein said supply of juice concentrate includes various flavors of juice concentrate and wherein said controller operatively controls which flavor of juice concentrate is selected, the operating characteristics of said pump and the operating temperature of said chiller.

5. The juice dispenser according to claim 2, further comprising:

a mounting bracket for detachably holding said dispensing head in a substantially vertical position.

6. In combination, a juice dispenser to repeatedly provide a known quantity of juice concentrate at a predetermined range of temperature for each dispense cycle and a thermally insulated tray for carrying a group of cups filled with juice from the known quantity juice dispenser, comprising:

a juice dispenser having a supply of juice concentrate and a supply of water;

a dispensing head for dispensing said supply of juice to any number of cups;

a chiller, connected between said supply of juice concentrate and said dispensing head, for lowering the temperature of said supply of juice concentrate to a predetermined range of temperature;

a pressure transducer connected to said dispensing head to provide pressure readings throughout a dispense cycle; and controller means for a) receiving the pressure readings of the concentrate from said pressure transducer during a first dispense cycle, b) summing the pressure readings from the first dispense cycle to provide a reference count, c) receiving a pressure reading from said pressure transducer during a subsequent dispense cycle to determine a viscosity of the concentrate, d) adjusting the reference count to an adjusted count value based upon the viscosity of the concentrate, e) receiving the pressure readings of the concentrate from said pressure transducer during the subsequent dispense cycle, and f) terminating the flow of concentrate when the summation of the pressure readings of the subsequent dispense cycle equals the adjusted count value; and a thermally insulated tray having a stackable tray with at least one cavity for receiving a thermally conductive material, an insulation plate received within said stackable tray, said insulation plate having holes for receiving the cups, and a cover received on the top of said stackable tray to enclose and thermally insulate the group of juice filled cups.

7. The combination according to claim 6, wherein said controller means further includes means for determining the viscosity value at a predetermined time after the dispense cycle has commenced.

8. The combination according to claim 7, wherein the juice dispenser further includes a mounting bracket for detachably holding said dispense head in a substantially vertical position.

9. The combination according to claim 8, wherein said stackable tray further includes a bottom with an upwardly extending wall around the perimeter thereof, said wall having an inwardly extending shoulder to support said insulation plate and wherein said bottom, said wall and said insulation plate form a first insulation chamber.

10. The combination according to claim 9, wherein said wall has a first nesting member extending therefrom and wherein said cover has an edge with a channel, wherein said first nesting member is received within said channel when said cover is received on the top of said stackable tray, and wherein said bottom, said wall and said insulation plate form a second insulation chamber.

11. The combination according to claim 10, wherein said wall has a second nesting member and wherein said first and second nesting members are receivable by nesting members of other stackable trays.

12. A tray for thermally insulating a group of cups filled with juice from a juice dispenser, comprising:

a stackable tray with at least one cavity for receiving a temperature conductive material, said stackable tray having a shoulder;

an insulation plate detachably received within said stackable tray and resting upon just said shoulder, said insulation plate having a pluarity of holes where at least one of said holes receives a cup supported by said insulation plate; and a cover received on the top of said stackable tray to enclose and thermally insulate the group of cups.

13. The tray according to claim 12, wherein said stackable tray further comprises:

a bottom;

a wall, upwardly extending from the perimeter of said bottom wherein said shoulder, inwardly extends from said wall to support said insulation plate, and wherein said bottom, said wall and said insulation plate form a first insulation chamber.

14. The tray according to claim 13, wherein said wall further comprises:

a first nesting member extending from the top of said wall; and a second nesting member extending from the bottom of said wall, wherein said first and second nesting members are receivable by nesting members of other stackable trays.

15. The tray according to claim 14, wherein said cover has an edge with a channel that is mateable with said first nesting member.

16. The tray according to claim 15, wherein said insulation plate supports the cups in such a manner that the cups are never in contact with any other portion of said tray and said temperature conductive material.

17. A juice dispenser to provide a known quantity of juice at each dispensing cycle, comprising:

a supply of juice concentrate;

a hose;

a dispensing head connected to said supply of juice concentrate by said hose;

a pressure transducer connected to one of said hose and said dispensing head to provide pressure readings throughout a dispense cycle; and controller means for a) receiving the pressure readings of the concentrate from said pressure transducer during a first dispense cycle, b) summing the pressure readings from the first dispense cycle to provide a reference count, c) receiving the pressure readings of the concentrate from said pressure transducer during the subsequent dispense cycle, and d) terminating the flow of concentrate when the summation of the pressure readings of the subsequent dispense cycle equals the reference count.

18. The juice dispenser according to claim 17 further comprising:

at least one valve disposed between said supply of juice concentrate and said dispensing head operatively opened and closed by said controller; wherein said reference count is determined by summing readings of said pressure transducer at predetermined time intervals while said valve is open until such sum indicates the known volume of said supply of juice concentrate has been dispensed and wherein said valve is closed whenever said reference count is obtained at each subsequent dispense cycle.

19. The juice dispenser according to claim 18, wherein said supply of juice concentrate includes various flavors of juice concentrate, the flow of which is controlled by a corresponding valve, and wherein said controller controls which flavor of juice concentrate is selected by opening and closing said corresponding valve.

* * * * *